US005941525A

United States Patent [19]

Gallub

[11] Patent Number: 5,941,525

[45] Date of Patent: Aug. 24, 1999

[54] BLACK WIDOW BOARD GAME

[76] Inventor: Frank Gallub, P.O. Box 54, Vale, N.C. 28168-0054

[21] Appl. No.: 09/074,129

[22] Filed: May 7, 1998

[51] Int. Cl.[6] ..... A63F 3/00

[52] U.S. Cl. ..... 273/248

[58] Field of Search ..... 273/242, 243, 273/248, 249

[56] References Cited

U.S. PATENT DOCUMENTS

| | | | |
|---|---|---|---|
| D. 132,124 | 4/1942 | Dunlap | 273/248 X |
| D. 355,448 | 2/1995 | Walter et al. . | |
| 651,811 | 6/1900 | Sexton | 273/248 |
| 2,086,864 | 7/1937 | Gerber | 273/248 |
| 3,104,106 | 9/1963 | Kenney et al. | 273/248 X |
| 3,762,714 | 10/1973 | Wilson | 273/248 |
| 4,557,485 | 12/1985 | Lardon | 273/248 |
| 4,832,347 | 5/1989 | Monticolombi . | |
| 5,090,706 | 2/1992 | Hokanson . | |
| 5,156,406 | 10/1992 | Johnson et al. . | |
| 5,386,994 | 2/1995 | Baranowski | 273/248 X |

*Primary Examiner*—William E. Stoll
*Attorney, Agent, or Firm*—Michael I. Kroll

[57] ABSTRACT

A black widow board game (10) comprising a plurality of game pieces (12), in which a group of four of the game pieces (12) are color coded and used by one particular player during the game. A board (14) is provided, having a continuous path around its perimeter divided into consecutive spaces (16). Each of the spaces (16) bear instructions representing various tasks to do during the play of the game. Some of the spaces (16) represent amounts of money to be paid and received by each player, when one of the game pieces (12) lands thereon. There are four start position spaces (18), each located at one corner of the game board (14) to be used by a particular player to start the four game pieces (12) therefrom. There are also four home paths extending inwardly from each corner and divided into consecutive spaces (20) to be used by one particular player to reach a home space (22) to win the game.

25 Claims, 3 Drawing Sheets

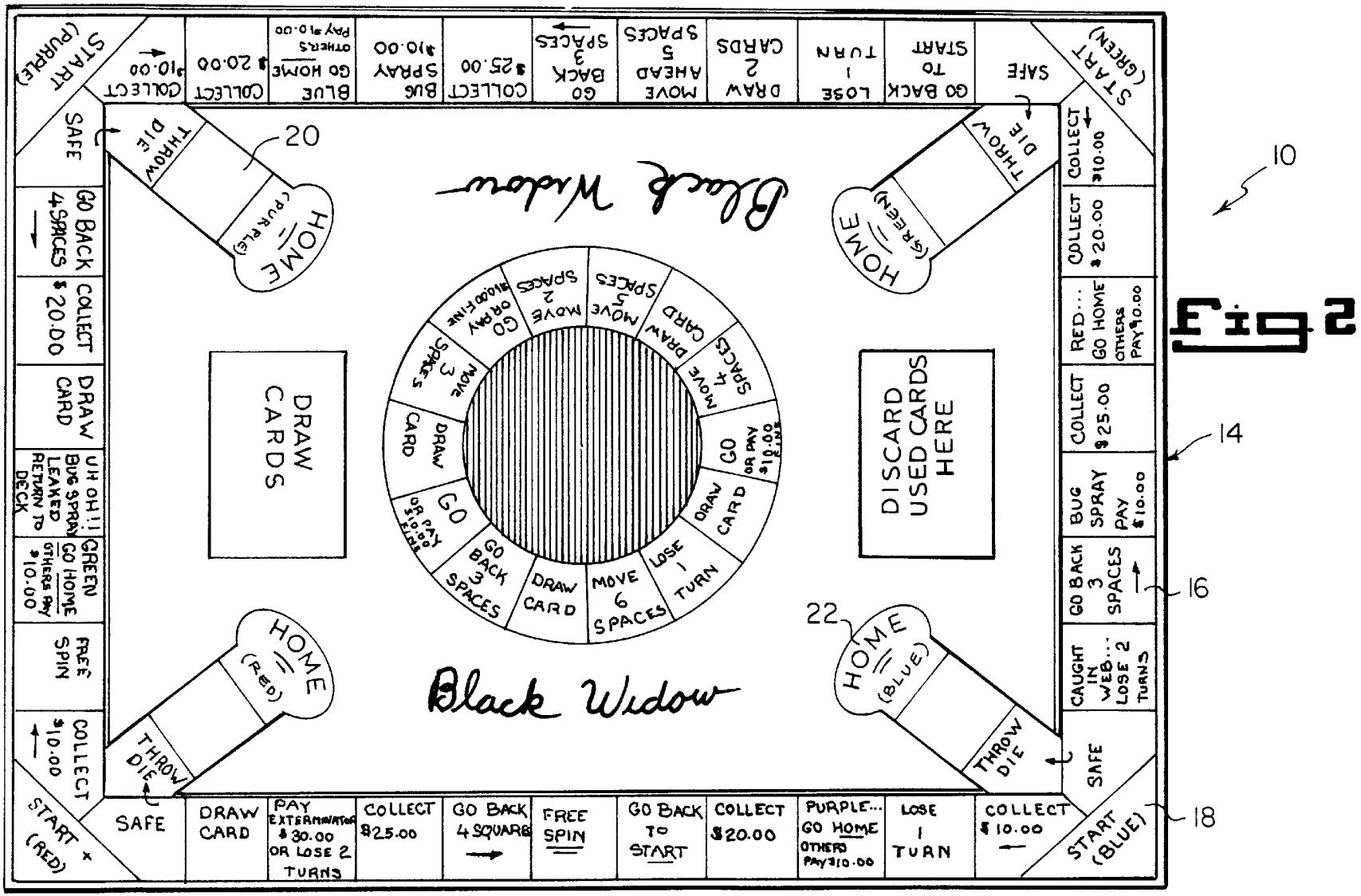
Fig 2
10
14
16
18
20
22
START (GREEN)
COLLECT $10.00
COLLECT $20.00
RED... GO HOME OTHERS PAY $10.00
COLLECT $25.00
BUG SPRAY PAY $10.00
GO BACK 3 SPACES
CAUGHT IN WEB... LOSE 2 TURNS
SAFE
START (BLUE)
COLLECT $10.00
LOSE 1 TURN
PURPLE... GO HOME OTHERS PAY $10.00
COLLECT $20.00
GO BACK TO START
FREE SPIN
GO BACK 4 SQUARES
COLLECT $25.00
PAY EXTERMINATOR $30.00 OR LOSE 2 TURNS
DRAW CARD
SAFE
START (RED)
COLLECT $10.00
FREE SPIN
GREEN GO HOME OTHERS PAY $10.00
UH OH!! BUG SPRAY LEAKED RETURN TO DECK
DRAW CARD
COLLECT $20.00
GO BACK 4 SPACES
SAFE
START (PURPLE)
COLLECT $10.00
COLLECT $20.00
BLUE GO HOME OTHERS PAY $10.00
BUG SPRAY $10.00
COLLECT $25.00
GO BACK 3 SPACES
MOVE AHEAD 5 SPACES
DRAW 2 CARDS
LOSE 1 TURN
GO BACK TO START
SAFE
HOME (GREEN)
THROW DIE
HOME (BLUE)
THROW DIE
HOME (PURPLE)
THROW DIE
HOME (RED)
THROW DIE
DISCARD USED CARDS HERE
DRAW CARDS
Black Widow
Black Widow
GO OR PAY $10.00 FINE
DRAW CARD
GO BACK 3 SPACES
GO OR PAY $10.00 FINE
DRAW CARD
MOVE 6 SPACES
LOSE 1 TURN
DRAW CARD
GO OR PAY $10.00 FINE
MOVE 4 SPACES
DRAW CARD
MOVE 5 SPACES
MOVE 2 SPACES
MOVE 3 SPACES

BLACK WIDOW BOARD GAME

BACKGROUND OF THE INVENTION

1. Field of the Invention

The instant invention relates generally to game board apparatuses and more specifically it relates to a black widow board game. The black widow board game is a fun game for all to play because of it's unique characteristics, which focuses on spiders, especially the black widow spider. The black widow board game utilizes a bag containing a plurality of simulated garden spiders and one black widow spider being made out of a soft type rubber. This will give the feel of real spiders when each player sticks their hand into the bag during the play of the game, to remove one of the spiders therefrom.

2. Description of the Prior Art

Numerous game board apparatuses have been provided in prior art. For example, U.S. Pat. Nos. 4,832,347 to Monticolombi; 5,090,706 to Hokanson; 5,156,406 to Johnson et al. and D355,448 to Walter et al. all are illustrative of such prior art. While these units may be suitable for the particular purpose to which they address, they would not be as suitable for the purposes of the present invention as heretofore described.

Monticolombi, Carlo G. R.

Board Game

U.S. Pat. No. 4,832,347

A board game comprises a board defining an enclosed track of adjacent spaces. A spinner positioned at the center of the board has elements which randomly identify at least one of the spaces by pointing to the spaces. The game further comprises a plurality of playing pieces to be moved from space to space by players, and a pair of dice to indicate the number of spaces the playing pieces can be moved. According to the rules, if a spinner element randomly points to a space occupied by a playing piece, that playing piece may be removed from the board.

Hokanson, Harlen C.

Game Apparatus

U.S. Pat. No. 5,090,706

Game apparatus including a game board having a central manually rotatable disk with color selection indicia thereon and a circular track surrounding the disk and having a plurality of division spaces thereon to define the playing path for each of the players. A set of dice are used, each die being uniformly colored with a different color such that each die corresponds to a color of the selection disk. The preselected numbering of each die are such that a non-transitive relationship exists between the dice. To define this relationship, a competitive throwing of die is played where one player picks a die, then an opposing player picks a die from the remaining set of dice which both dice are thrown with the winner being the player who's die displays the higher number. Regardless of which die the first player picked, the opposing player can always pick a die having approximately a two-thirds probability of winning. The relative outcome of this competitive throwing of the dice determines the number of spaces and the direction the playing pieces move along the track.

Johnson, Cordelia

Johnson, Lawrence

Board Game of Spinner Assembly Dice and Pieces

U.S. Pat. No. 5,156,406

A board game apparatus including a playing board having a surface with a plurality of contiguous rows of spaces, a plurality of designated spaces for initial positioning of sets of game pieces, as well as a plurality of distinguishable finishing zones. The game apparatus is adapted with a combination of chance devices (1) Spinner Assembly and Chips (2) Dice. Wherein, multiple game pieces are advanced on the playing surface by the spin of the wheel or response to dice, to determine the number of spaces the player moves on the game board. The players may at their own option either spin the wheel or toss the dice in an effort to decide which player opens the game. To win one of the players must succeed in placing all of their game pieces in scoring positions, avoiding the obstacle members on the game board.

Walter, James

Walter, Kim

Spiral Spider Web Game Board

U.S. Pat. No. D.335,448

The ornamental design for a spiral spider web game board, as shown and described.

FIG. 2 is a reduced bottom plan view thereof; and

FIG. 3 is a reduced side elevational view thereof, the other sides being identical.

SUMMARY OF THE INVENTION

Figure 1:
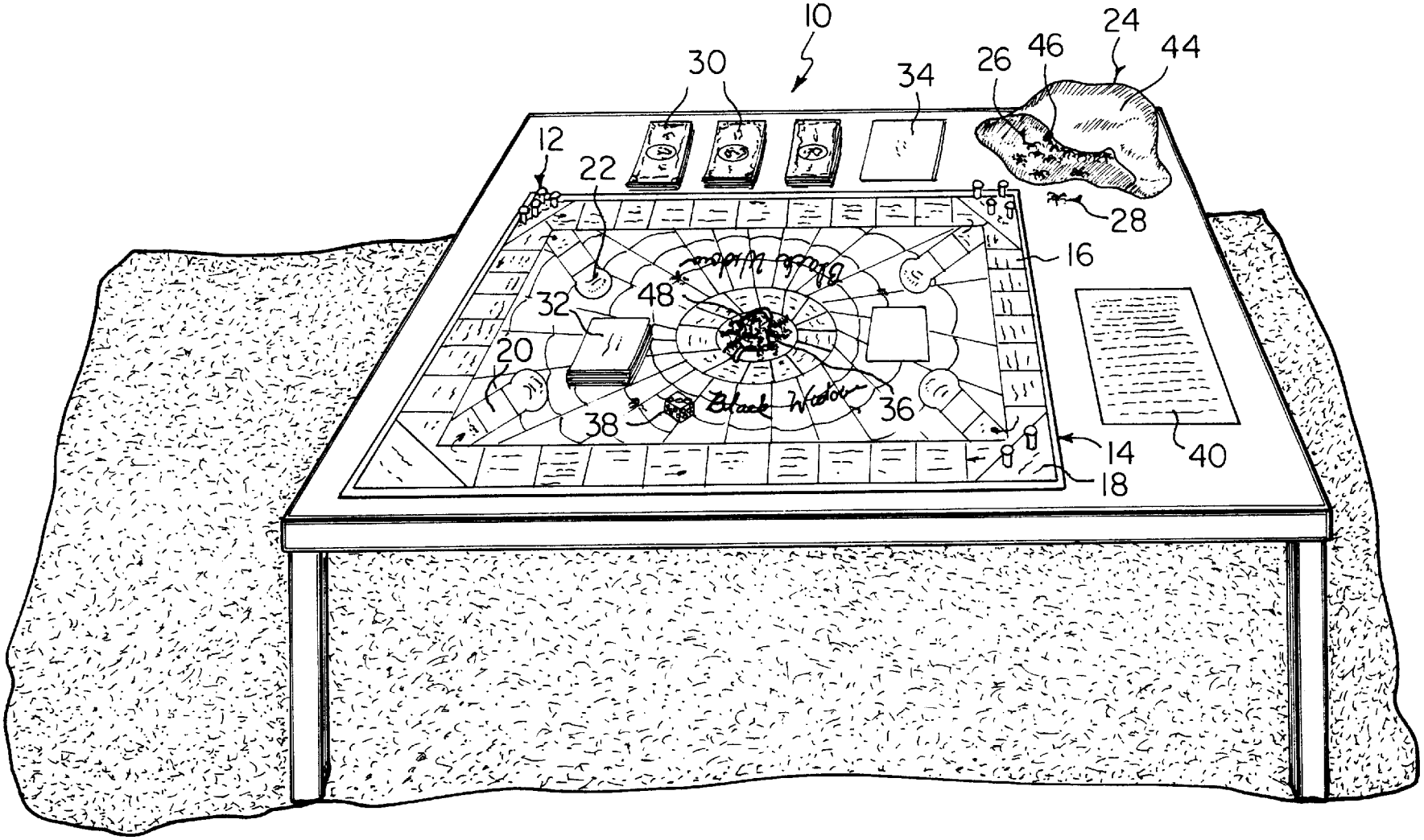
FIG. 1 is a top plan view of a spiral spider web game board, showing the new design.

A primary object of the present invention is to provide a black widow board game that will overcome the shortcomings of the prior art devices.

Another object is to provide a black widow board game that will be a fun game for all to play, because of it's unique characteristics, which focuses on spiders, especially the black widow spider.

An additional object is to provide a black widow board game that utilizes a bag containing a plurality of simulated garden spiders and one black widow spider being made out of a soft type rubber, which will give the feel of real spiders when each player sticks their hand into the bag during the play of the game, to remove one of the spiders therefrom.

A further object is to provide a black widow board game that is simple and easy to use.

A still further object is to provide a black widow board game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of the present invention on a table ready to be played.

Figure 1A:
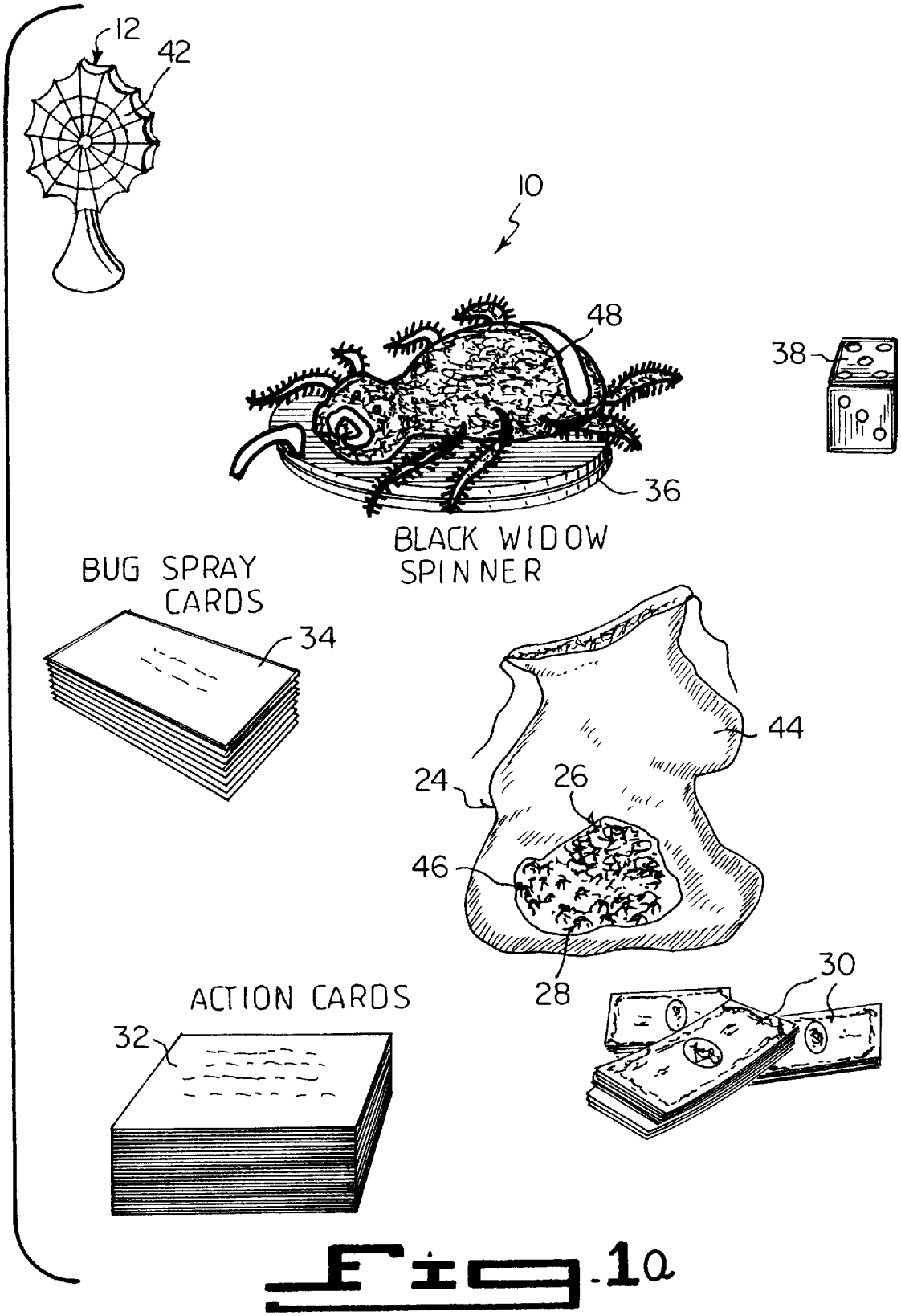

FIG. 1*a* is a perspective view showing the various components used in playing the game.

FIG. 2 is a top plan view of the game.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1, 1*a* and 2 illustrate the present invention being a black widow board game 10. With regard to the reference numerals used, the following numbering is used throughout the various drawing figures.

| | |
|---|---|
| 10 | black widow board game |
| 12 | game piece of 10 |
| 14 | game board of 10 |
| 16 | space on 14 |
| 18 | start position space on 14 |
| 20 | home path space on 14 |
| 22 | home space on 14 |
| 24 | spider bag of 10 |
| 26 | simulated garden spider of 10 |
| 28 | simulated black widow spider of 10 |
| 30 | play money of 10 |
| 32 | action card of 10 |
| 34 | bug spray card of 10 |
| 36 | spinner of 10 |
| 38 | die of 10 |
| 40 | set of rules of 10 |
| 42 | spider web on 12 |
| 44 | soft black velvet feeling sack for 24 |
| 46 | soft gel type rubber for 26 and 28 |
| 48 | large simulated black widow spider on 36 |

The black widow board game 10 comprises a plurality of game pieces 12, in which a group of four of the game pieces 12 are color coded (such as blue, red, purple and green), and used by one particular player during the game. A game board 14 is provided, having a continuous path around its perimeter divided into consecutive spaces 16. Each of the spaces 16 bear instructions representing various tasks to do during the play of the game. Some of the spaces 16 represent amounts of money to be paid and received by each player when one of the game pieces 12 lands thereon. There are four start position spaces 18, each located at one corner of the game board 14, to be used by a particular player to start the four game pieces 12 therefrom. There are also four home paths extending inwardly from each corner and divided into consecutive spaces 20, to be used by one particular player to reach a home space 22 to win the game.

The black widow board game 10 further includes a spider bag 24. A plurality of simulated garden spiders 26 are placed into the spider bag 24, to be picked and removed by each player during the play of the game. A simulated black widow spider 28 is placed into the spider bag, not to be picked and removed by each player during the play of the game. A plurality of play money 30 of different denominations is provided, for distribution of a part thereof to each player to be used during the play of the game.

The black widow board game 10 further contains a plurality of action cards 32, in which each player can pick the action cards, one at a time, during the play of the game and follow instructions thereon. A plurality of bug spray cards 34 are also provided. Each player can buy one bug spray card 34 if a game piece 12 lands on a space 16 having instructions to purchase the bug spray card 34.

The black widow board game 10 further comprises a spinner 36, which when operated will indicate the number of spaces 16 to be moved by each game piece 12 on the spaces 16 about the perimeter of the game board 14, and other instructions to be followed by each player.

A die 38 is provided having indicia thereon indicating numbers from between one and six. The die 38 is only utilized when a game piece 12 of a player reaches its respective home path. The die 12 will be rolled to indicate the move of the game piece 12 to the home space 22. A set of rules 40 are used by the players during the play of the game. Each game piece 12 is characterized by a structure representing a spider web 42. The spider bag 24 is a soft, black velvet feeling sack 44.

Each simulated garden spider 26 is fabricated out of a soft gel type rubber 46, that will give the feel of a real spider when a player sticks a hand into the spider bag 24. The simulated black widow spider 28 is also fabricated out of the soft gel type rubber 46, so as to give the feel of a real spider when a player sticks a hand into the spider bag 24. The spinner 36 includes a large simulated black widow spider 48 mounted thereon, which will rotate with the spinner 36.

Rules of the Game

Welcome to the world of the black widow. You have managed to wander outside the web of the feared black widow. You must get back home before the black widow gets you. To accomplish this, you must get all four of your player pieces into you home space. This can only be accomplished by each game piece taking a journey around the web of the giant black widow. Each time one of your game pieces makes it to your home space, you have made one successful journey around the web. Beware, during play, you will be forced to pick spiders from the spider bag. Only one of the spiders is the black widow. Pull the black widow from the bag, and you are a goner! Out of the game! But just in case you do, there may be hope for you, if you play your cards right!

Object Of The Game:

To win, the first player to successfully get all four of their game pieces into their respective home space, wins the game. Each player must move all their game pieces around the game board without picking the black widow spider from the spider bag. A player picking the dreaded critter is a goner, unless they possess a bug spray card (see bug spray instructions).

Starting The Game:

Each player gets $50.00 to start from the bank. Each player puts their game pieces in the start space at a corner of the game board of their respective color. Every play must begin with a spin of the black widow spinner. To get a game piece out of the start space, the spinner must land on go. If the spinner lands on go, that player may move one game piece out, and begin travel in a clockwise direction around the game board. If the spinner does not land on go, the player waits for their next turn to try again. If the spinner lands on a draw card, the player must draw a card. The player must follow instructions on the card, unless it is a move card and the player has no game pieces out of their start space. A move card does not allow a player to take a game piece out of their start space. There are action cards that will allow a player to take a game piece from the start space, as indicated on the appropriate card.

Once a player enters a game piece on the game board, all following moves start with a spin, and following instructions on the action card or in the space the game piece lands on. If a second players lands their game pieces on the same space, the first player's game piece is bumped back to the start space, unless the space occupied is a safe space.

Spider Bag Usage:

Whenever a player must pick spiders from the spider bag, they must pick one spider at the time. All players keep their spiders unless indicated by an action card, to return their spiders to the spider bag. If all the spiders are out of the spider bag during game play, all players must return all their spiders to the spider bag. The black widow spider always gets returned into the spider bag. Only friendly spiders are held to increase the odds of picking the black widow spider during game play.

Use Bug Spray Cards:

When a player lands their game piece on a bug spray space, they may purchase the bug spray for the amount shown. A bug spray card is good for one use only. The bug spray card may be held until a player must pick spiders from the spider bag. If the player picks the black widow spider from the spider bag, they may use the bug spray card to ward off the evil critter and stay in the game. The black widow spider gets returned to the spider bag and the bug spray card gets put back to the respective area on the game board. If a player get more than one bug spray card, either by landing on that space again, or by directions on an action card, they may sell it to the highest bidder. The sale must be within that turn. If there is only one other player that may need the bug spray card, and the holder wishes to sell it, it may be sold for the price paid, or $20.00, whichever is greater.

Home Stretch:

Once a player gets their game piece around the game board, they must enter their respective home stretch. The move must be the exact number to get the game piece into the home space. If a player is directed to move six spaces, but there are only five spaces for that player to move into at the home stretch, they must either move another game piece or forfeit their turn, if they have no other game piece on the game board. Once a player lands their game piece anywhere in the home stretch, they have the option of spinning the spinner, or throwing the die. A one or a two will be the only numbers needed for this task. If a player decides to throw the die to try to get into home space and doesn't succeed, they may buy another throw for $25.00. If the player does buy another throw, and does not succeed, they must pick two spiders from the spider bag. Sorry, only one extra throw is allowed.

Remember, travelling around the web (game board) is easy. Just follow the instruction as you go. Also, the more spiders that are out of the spider bag, makes the risk of pulling the black widow greater with each grab. Play your cards right and follow the instructions on the action cards also, and you'll have fun.

Money:

One player must be designated as the banker. The banker is responsible for giving out all monies, and receiving all monies from each player during game play. Each player is to be paid the specified amount when they land on a pay space, or receive money as per a draw card instruction. Each player landing on a pay space, or get a pay instruction on a draw card, must pay the banker.

Note: If a player has no game piece left in their respective start space, and during their turn spin the spinner and land on go, they must pay a $10.00 penalty to the banker, (covers the wasted usage of the spinner).

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A black widow board game comprising:

a) a plurality of game pieces, in which a group of four of said game pieces are color coded and used by one particular player during the game; and b) a game board having a continuous path around its perimeter divided into consecutive spaces, each of said spaces bearing instructions representing various tasks to do during the play of the game, while some of said spaces represent amounts of money to be paid and received by each player when one of said game pieces lands thereon, four start position spaces, each located at one corner of said game board to be used by a particular player to start said four game pieces therefrom and four home paths extending inwardly from each corner and divided into consecutive spaces to be used by one particular player to reach a home space to win the game.

2. A black widow board game as recited in claim 1, further including:

a) a spider bag;

b) a plurality of simulated garden spiders placed into said spider bag to be picked and removed by each player during the play of the game; and c) a simulated black widow spider placed into said spider bag, not to be picked and removed by each player during the play of the game.

3. A black widow board game as recited in claim 2, wherein said spider bag is a soft, black velvet feeling sack.

4. A black widow board game as recited in claim 2, wherein each said simulated garden spider is fabricated out of a soft gel type rubber, that will give the feel of a real spider when a player sticks a hand into said spider bag.

5. A black widow board game as recited in claim 2, wherein said simulated black widow spider is fabricated out of a soft gel type rubber, that will give the feel of a real spider when a player sticks a hand into said spider bag.

6. A black widow board game as recited in claim 1, further including a plurality of play money of different denominations for distribution of a part thereof to each player to be used during the play of the game.

7. A black widow board game as recited in claim 1, further including a plurality of action cards, in which each player can pick said action cards during the play of the game and follow instructions thereon.

8. A black widow board game as recited in claim 1, further including a plurality of bug spray cards, in which each player can buy one said bug spray card if a game piece lands on a space having instruction to purchase said bug spray card.

9. A black widow board game as recited in claim 1, further including a spinner, which when operated it will indicate the number of spaces to be moved by each said game piece on the spaces about the perimeter of said game board and other instructions to be followed by each player.

10. A black widow board game as recited in claim 9, wherein said spinner includes a large simulated black widow spider mounted thereon, which will rotate with said spinner.

11. A black widow board game as recited in claim 1, further including a die having indicia thereon indicating numbers from between one and six, whereby said die is only utilized when a game piece of a player reaches its respective home path, so that said die will be rolled to indicate the move of said game piece to the home space.

12. A black widow board game as recited in claim 1, further including a set of instructions used by the players during the play of the game.

13. A black widow board game as recited in claim 1, wherein each said game piece is characterized by a structure representing a spider web.

14. A black widow board game comprising:

a) a plurality of game pieces, in which a group of four of said game pieces are color coded and used by one particular player during the game, wherein each said game piece is characterized by a structure representing a spider web; and b) a game board having a continuous path around its perimeter divided into consecutive spaces, each of said spaces bearing instructions representing various tasks to do during the play of the game, while some of said spaces represent amounts of money to be paid and received by each player when one of said game pieces lands thereon, four start position spaces, each located at one corner of said game board to be used by a particular player to start said four game pieces therefrom and four home paths extending inwardly from each corner and divided into consecutive spaces to be used by one particular player to reach a home space to win the game.

15. A black widow board game as recited in claim 14, further including:

a) a spider bag;

b) a plurality of simulated garden spiders placed into said spider bag to be picked and removed by each player during the play of the game; and c) a simulated black widow spider placed into said spider bag, not to be picked and removed by each player during the play of the game.

16. A black widow board game as recited in claim 15, further including a plurality of play money of different denominations for distribution of a part thereof to each player to be used during the play of the game.

17. A black widow board game as recited in claim 16, further including a plurality of action cards, in which each player can pick said action cards during the play of the game and follow instructions thereon.

18. A black widow board game as recited in claim 17, further including a plurality of bug spray cards, in which each player can buy one said bug spray card if a game piece lands on a space having instruction to purchase said bug spray card.

19. A black widow board game as recited in claim 18, further including a spinner, which when operated it will indicate the number of spaces to be moved by each said game piece on the spaces about the perimeter of said game board and other instructions to be followed by each player.

20. A black widow board game as recited in claim 19, further including a die having indicia thereon indicating numbers from between one and six, whereby said die is only utilized when a game piece of a player reaches its respective home path, so that said die will be rolled to indicate the move of said game piece to the home space.

21. A black widow board game as recited in claim 20, further including a set of instructions used by the players during the play of the game.

22. A black widow board game as recited in claim 21, wherein said spider bag is a soft, black velvet feeling sack.

23. A black widow board game as recited in claim 22, wherein each said simulated garden spider is fabricated out of a soft gel type rubber, that will give the feel of a real spider when a player sticks a hand into said spider bag.

24. A black widow board game as recited in claim 23, wherein said simulated black widow spider is fabricated out of a soft gel type rubber, that will give the feel of a real spider when a player sticks a hand into said spider bag.

25. A black widow board game as recited in claim 24, wherein said spinner includes a large simulated black widow spider mounted thereon, which will rotate with said spinner.

* * * * *